US009980063B2

(12) United States Patent
Johnson

(10) Patent No.: US 9,980,063 B2
(45) Date of Patent: May 22, 2018

(54) METHOD AND APPARATUS FOR INTEGRATING A LIVING-HINGE IN A HEARING INSTRUMENT

(71) Applicant: Starkey Laboratories, Inc., Eden Prairie, MN (US)

(72) Inventor: Nathan Curtis Johnson, Monticello, MN (US)

(73) Assignee: Starkey Laboratories, Inc., Eden Prairie, MN (US)

( * ) Notice: Subject to any disclaimer, the term of this patent is extended or adjusted under 35 U.S.C. 154(b) by 0 days. days.

(21) Appl. No.: 15/019,398

(22) Filed: Feb. 9, 2016

(65) Prior Publication Data

US 2016/0234614 A1 Aug. 11, 2016

Related U.S. Application Data

(60) Provisional application No. 62/113,828, filed on Feb. 9, 2015.

(51) Int. Cl.
*H04R 25/00* (2006.01)
*H04R 1/10* (2006.01)

(52) U.S. Cl.
CPC ..... *H04R 25/60* (2013.01); *H04R 1/1041* (2013.01); *H04R 25/65* (2013.01); *H04R 2225/021* (2013.01); *H04R 2225/61* (2013.01)

(58) Field of Classification Search
CPC ..... H04R 25/60; H04R 25/65; H04R 1/1041; H04R 2225/021; H04R 2225/61; H01H 9/02
See application file for complete search history.

(56) References Cited

U.S. PATENT DOCUMENTS 5,631,053 A * 5/1997 Andersen ..... B01F 3/1214 16/221
8,565,462 B2 10/2013 Fideler et al.
8,891,801 B1 * 11/2014 Leibsohn ..... H04R 1/026 381/301
2009/0136069 A1 * 5/2009 Heerlein ..... H04R 25/602 381/323
2011/0268295 A1 * 11/2011 Yamkovoy ..... H04B 1/385 381/119
2014/0138235 A1 * 5/2014 Savicki, Jr. ..... H01H 23/168 200/558

* cited by examiner

*Primary Examiner* — Tuan D Nguyen
(74) *Attorney, Agent, or Firm* — Schwegman Lundberg & Woessner, P.A.

(57) ABSTRACT

Disclosed herein, among other things, are systems and methods for integrating a living-hinge in a hearing instrument. A system may include a living-hinge cover for a momentary, multi-function switch. The living-hinge switch may be used for volume adjustment. The system may be used to prevent debris ingress or rattling sounds.

9 Claims, 6 Drawing Sheets

METHOD AND APPARATUS FOR INTEGRATING A LIVING-HINGE IN A HEARING INSTRUMENT

CROSS REFERENCE TO RELATED APPLICATIONS

This application claims the benefit of priority under 35 U.S.C. § 119(e) of U.S. Provisional Application Ser. No. 62/113,828 filed Feb. 9, 2015, which is hereby incorporated by reference herein in its entirety.

BACKGROUND

Modern hearing instruments typically include a multi-function, momentary switch. The switch is used to change internal memory presets or to adjust volume of the hearing instrument. In general, a conventional momentary switch contains some type of actuator mechanism along with a switch cover. Disadvantages of these approaches include audible rattling during a manual shake test, tolerance issues due to manufacturing, and high cost. Other switches incorporating capacitive-touch or other touch-sensitive technologies have also been used. One drawback of touch-sensitive switches is that users may prefer a tactile switch.

SUMMARY

Disclosed herein, among other things, are systems and methods for integrating a living-hinge in a hearing instrument. Systems and methods may include a living-hinge (e.g., a momentary switch) in a housing of a hearing instrument, such as a behind-the-ear hearing (BTE) instrument. The living-hinge may include a tactile feel, robust design, barrier to debris ingress, or consistent housing connections, placement, or surfaces.

This Summary is an overview of some of the teachings of the present application and not intended to be an exclusive or exhaustive treatment of the present subject matter. Further details about the present subject matter are found in the detailed description and appended claims. The scope of the present invention is defined by the appended claims and their legal equivalents.

DETAILED DESCRIPTION

The following detailed description of the present subject matter refers to subject matter in the accompanying drawings which show, by way of illustration, specific aspects and examples in which the present subject matter may be practiced. These examples are described in sufficient detail to enable those skilled in the art to practice the present subject matter. References to "an", "one", or "various" examples in this disclosure are not necessarily to the same example, and such references contemplate more than one example. The following detailed description is demonstrative and not to be taken in a limiting sense. The scope of the present subject matter is defined by the appended claims, along with the full scope of legal equivalents to which such claims are entitled.

Figure 1:
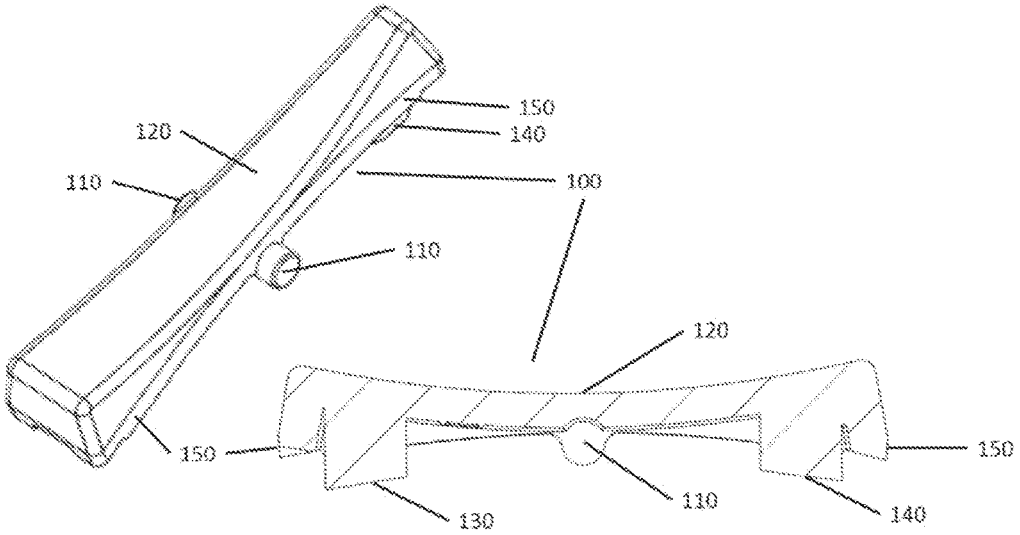
FIG. 1 illustrates a rocker switch.

FIG. 1 illustrates a rocker switch 100. FIG. 1 includes an oblique view (left) and section view (right) of an example rocker switch 100. Rocker switch 100 contains a cylindrical hinge 110, an exterior curved surface 120, a switch actuator 130, and a switch actuator 140. In an example, the rocker switch 100 may include a male cylindrical hinge 110 as a pivot. When rocker switch 100 is pressed on exterior surface 120 above actuator 130, rocker switch 100 may rotate counterclockwise around male cylindrical hinge 110 thereby engaging actuator 130 while disengaging actuator 140. In another example, when rocker switch 100 is pressed on exterior surface 120 above actuator 140, rocker switch 110 rotates clockwise around cylindrical hinge 110 thereby engaging actuator 140 while disengaging actuator 130. The perimeter of rocker switch 100 may feature an orthogonal surface 150.

Figure 2:
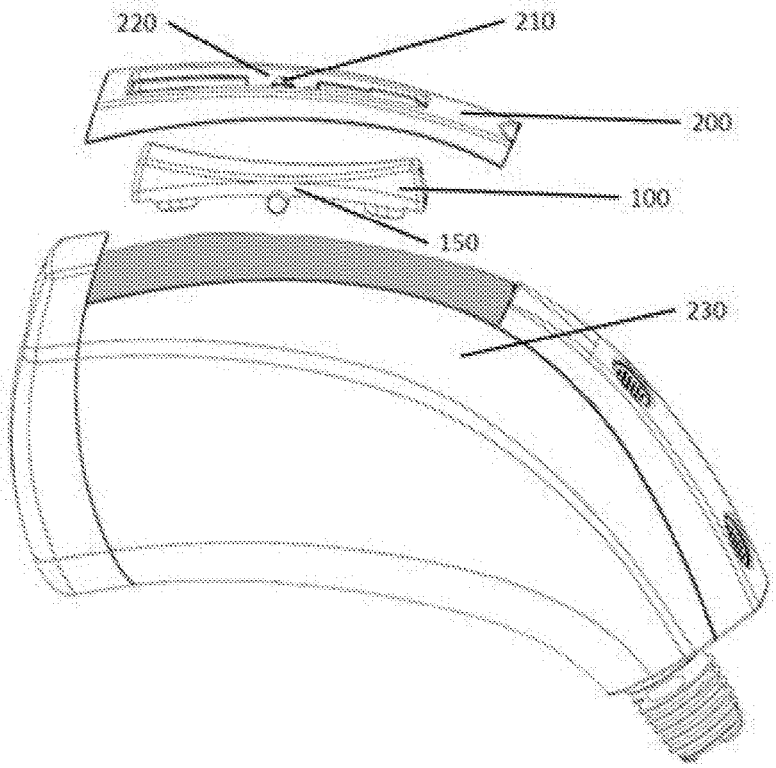
FIG. 2 illustrates an exploded view of a rocker switch.

FIG. 2 illustrates an exploded view of a rocker switch 100. FIG. 2 includes an exploded view of a rocker switch 100, a hearing instrument 230, and a switch cover 200. The rocker switch 100 may be attached to the switch cover 200 and held in place by a female cylindrical seat 210. The cutout of the switch cover 200 may contain its own orthogonal surface 220 that, when assembled, may abut orthogonal surface 150.

Figure 3:
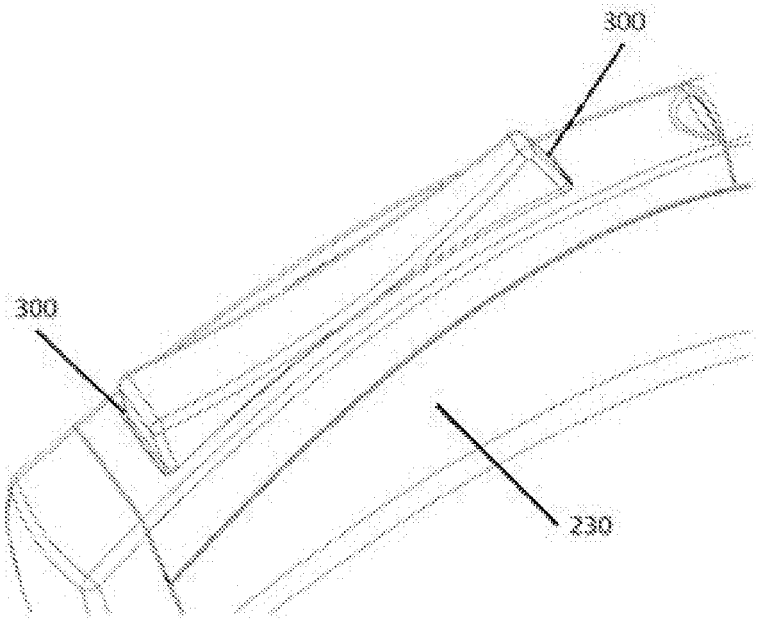
FIG. 3 illustrates a close-up view of a rocker switch.

FIG. 3 illustrates a close-up view of a rocker switch (not labeled). The rocker switch 100 and switch cover 200 of FIGS. 1 and 2 may attach to a hearing instrument 230 in FIG. 3, which may create a butt joint 300. If molding tolerances are not kept tight, the butt joint 300 may be loose, leading to a rattling effect when handled and also providing a potential path for debris ingress. More complex joints may not be possible with this approach. In another example, a rocker switch 100 may not contain male a cylindrical hinge 110 so it may not snap into the hearing instrument but rather may be sandwiched loosely between the switch cover and the hearing instrument housing. Audible rattling and debris ingress may be worse with this approach. Thus, FIGS. 1-3 illustrate previous solutions that have disadvantages that are overcome by the present subject matter.

Figure 4:
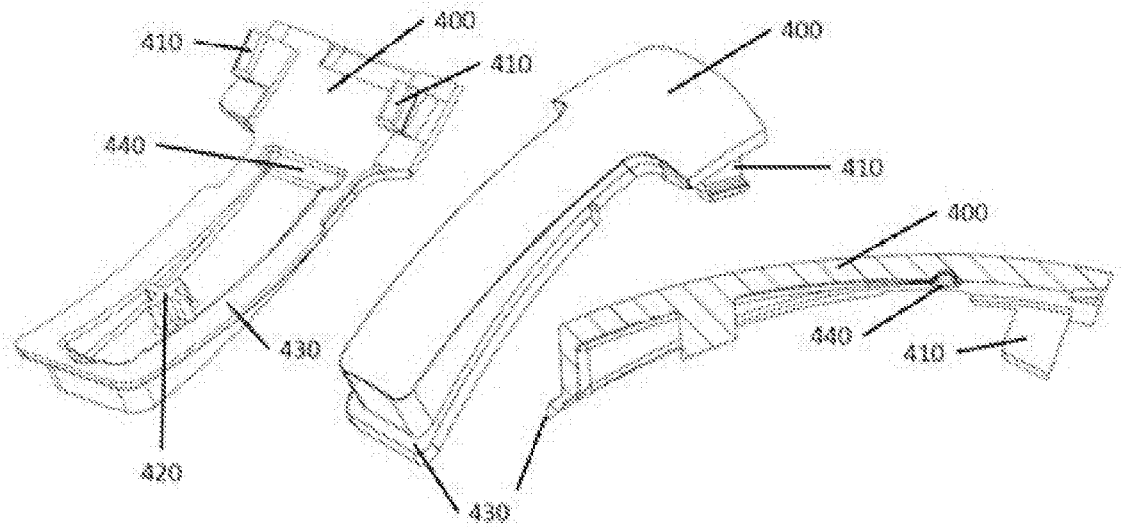
FIG. 4 illustrates a living-hinge switch, according to an embodiment of the present subject matter.

FIG. 4 illustrates a living-hinge switch 400 according to an embodiment of the present subject matter. The living-hinge switch 400 may integrate a switch actuator 420 and a switch cover into a single component, which may reduce tolerance stack-up while providing a more-robust joint condition, such as an overlap joint instead of a butt joint. In an example, the living-hinge switch 400 includes integration of an aesthetically-pleasing conventional momentary switch into a hearing instrument while preventing debris ingress and audible rattle. The living-hinge switch 400 in a hearing instrument application may undergo very small strain. There are a number of ways a living-hinge switch could be designed. In one example in FIG. 4, the living-hinge switch 400 is molded with snap features 410, actuator 420, perimeter ridge 430, and local weak spot 440.

In an example, the actuator 420 and perimeter ridge 430 may be mirrored on the other side of snap features 410 for a dual actuator design. This design may operate as an up/down volume control and may provide the benefits of the living-hinge.

In an example, the living-hinge may actuate a switch using no separate parts. For example, consider the top of a hearing instrument as one smooth surface where the user pushes in the center of the surface to actuate the switch underneath. In this example, the living-hinge actuates a switch without any need for additional parts. In another example, the living-hinge switch may be integrated into a battery drawer. In this example, the living-hinge switch may undergo large strains.

Figure 5:
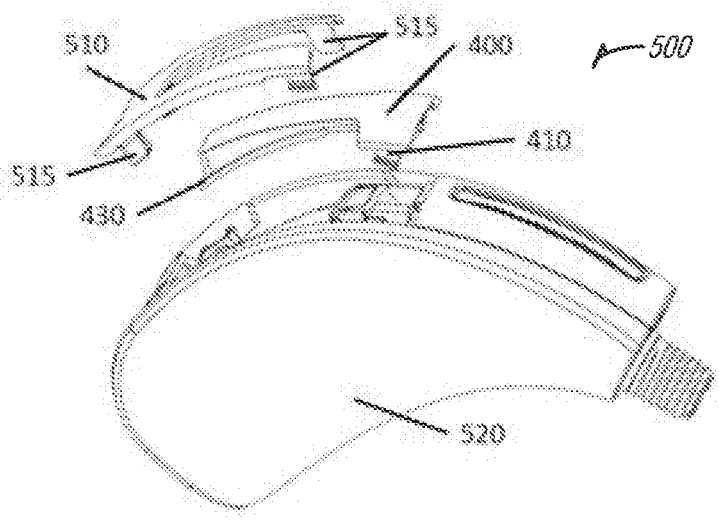
FIG. 5 illustrates a system including a living-hinge switch and a hearing instrument, according to an embodiment of the present subject matter.

FIG. 5 illustrates a system 500 including a living-hinge switch 400 and a hearing instrument according to an embodiment of the present subject matter. In an example, living-hinge switch 400 together with a switch bezel 510 and switch bezel barbed snaps 515 may be attached to a hearing instrument 520. The underside of switch bezel 510 may create an overlap joint and slight contact interference with perimeter ridge 430. In an example, the living-hinge switch 400 reduces the number of piece parts for a switch or hearing instrument. The living-hinge switch 400 may provide a tighter tactile feel for the end user. In another example, the living-hinge switch allows an overlap joint around a perimeter of a switch cover and may be less vulnerable to foreign debris. In yet another example, the living-hinge switch eliminates rattle noise during handling. The living-hinge switch may provide a sleeker profile for industrial design.

Figure 6:
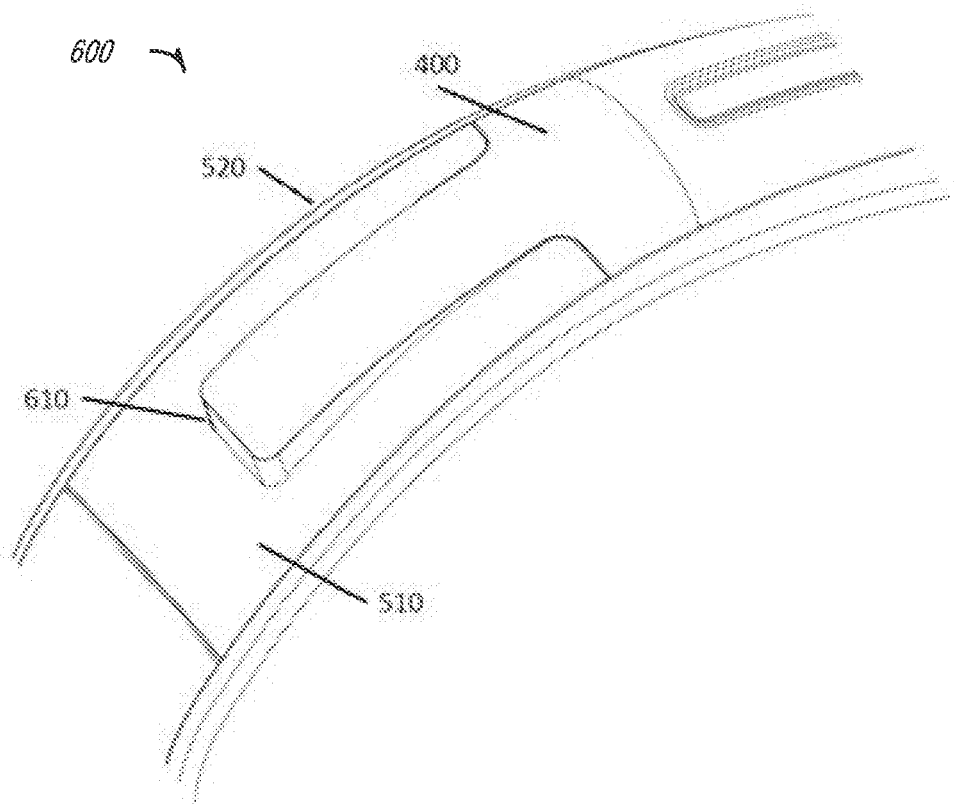
FIG. 6 illustrates a close-up view of parts of a system including a living-hinge switch and a hearing instrument, according to an embodiment of the present subject matter.

FIG. 6 illustrates a close-up view of parts of a system 600 including a living-hinge switch 400 and a hearing instrument 520 according to an embodiment of the present subject matter. In an example, the system 600 may include the hearing instrument 520 and a switch bezel 510 covering the living-hinge switch 400. When the switch bezel 510 covers the living-hinge switch 400, an overlap joint 610 may be created. In another example, snap features 410 attach living-hinge switch 400 to the hearing instrument 520 allowing the actuator 420 on the opposite end of snap features 410 to deflect subtly. The dimensions and tolerances of switch bezel 510 and switch bezel barbed snaps 515 may be engineered to interfere slightly with perimeter ridge 430 of living-hinge switch 400. This slight interference may create a contact condition that that prevents rattling and that inhibits debris ingress.

Figure 7:
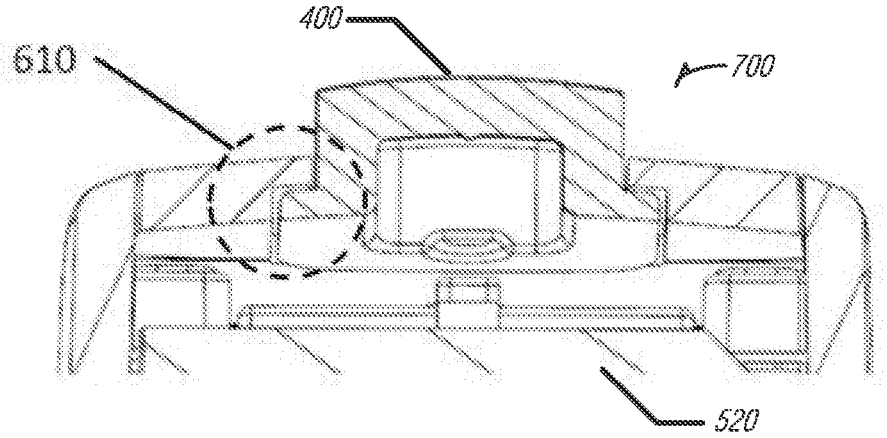
FIG. 7 illustrates a cross-section view of parts of a system including a living-hinge switch and a hearing instrument, according to an embodiment of the present subject matter.

FIG. 7 illustrates a cross-section view of parts of a system 700 including a living-hinge switch 400 and a hearing instrument 520 according to an embodiment of the present subject matter. As shown in the section view of FIG. 7, an overlap joint 610 may be more robust than a butt joint, such as the butt joint 300 shown in FIG. 3, because the overlap joint 610 may create a more tortuous path for debris ingress.

The methods described above provide ways to mount a momentary switch within the housing of a BTE hearing instrument so as to improve its tactile feel, improve its robustness to debris ingress, and provide more consistent case gaps. An example may include a plastic, living-hinge cover for a momentary, multi-function switch. In an example, the perimeter of the living-hinge switch provides an overlap joint boundary condition that is less susceptible to debris ingress than other switches. In another example, the living-hinge switch eliminates rattle noise. The profile of the living-hinge switch may provide a sleeker aesthetic for industrial design.

In an example, the living-hinge switch may be made of plastic, rubber, metal, etc. The living-hinge switch may include a material or color similar to a hearing instrument, a switch cover, a battery case, or another apparatus connected to a system for aiding in hearing assistance. In an example, the living-hinge switch may be integrated into the housing of the hearing instrument, which may reduce the number of piece parts and simplify final assembly of the hearing instrument. In another example, the living-hinge switch provides a tighter tactile feel for an end user.

In an example, a system may include a hearing instrument, a living-hinge switch attached to the hearing instrument, the living-hinge switch configured to adjust volume on the hearing instrument, and a switch cover attached to the hearing instrument. The system may include, wherein at least one surface of the switch cover is in contact with at least one surface of the living-hinge.

Figure 8:
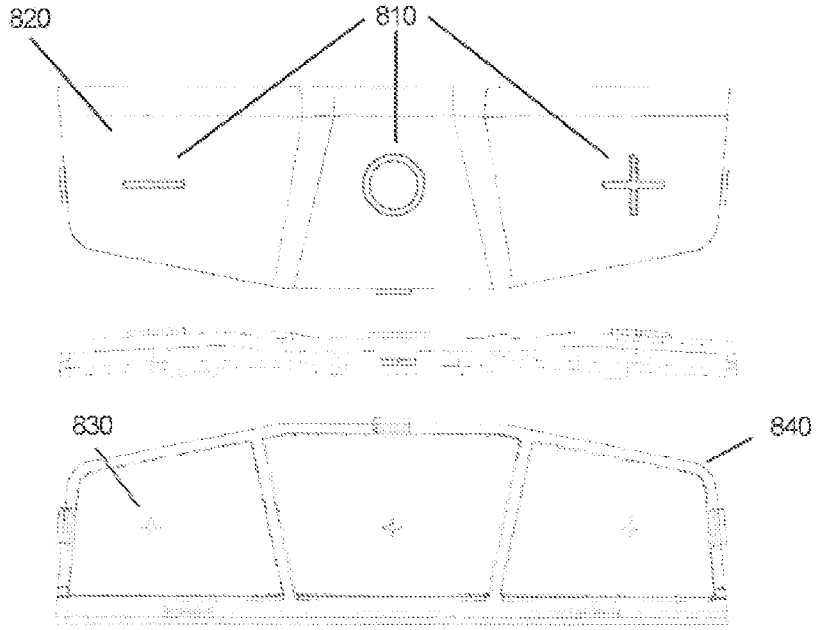
FIGS. 8-9 illustrate close-up views of a triple living hinge for a hearing instrument, according to various embodiments of the present subject matter.
Figure 9:
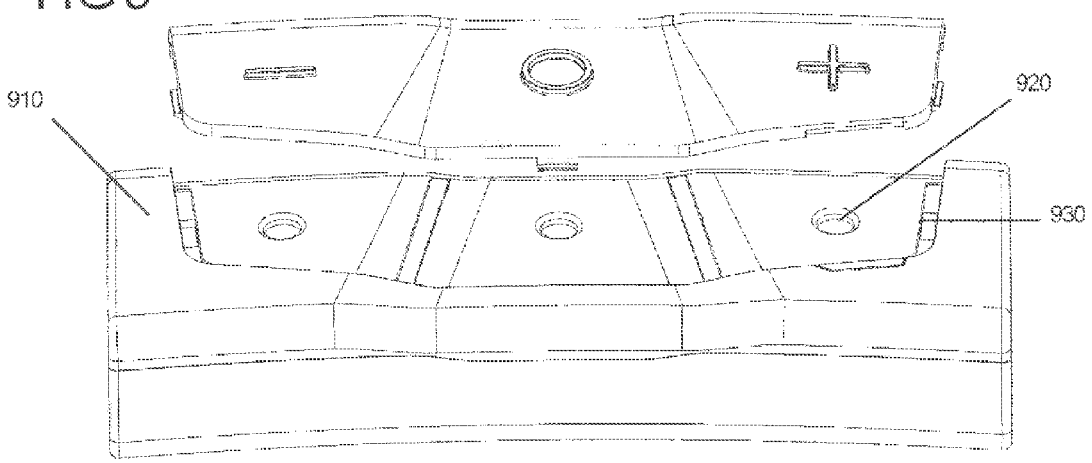

Various embodiments of the present subject matter include a triple living hinge. In one embodiment, the triple living hinge is used on an electronic headset device. The triple living hinge can be used on other hearing instruments without departing from the scope of the present subject matter. FIGS. 8-9 illustrate close-up views of a triple living hinge for a hearing instrument, according to various embodiments of the present subject matter. A switch actuator 810 with triple living hinge 820 shown in FIG. 8. The "–", "O", and "+" symbols represent three separate buttons that control volume and power, in an embodiment. Molding these all into a single part creates a significant cost savings by reducing the number of plastic parts needed (from four to one), and considerably improves device quality. In one embodiment, switch actuation force is controlled by the plastic wall section thickness in the localized area behind 820.

In various embodiments, raised plus features 830 on the backside of switch actuator 810 protrude through front case part 910 via circular openings 920 to actuate switches on the PCB, as shown in FIG. 9. The perimeter rib 840 on switch actuator 810 interfaces with inset groove 930 on front case 910, in various embodiments. This interface prevents the user from actuating multiple switches simultaneously, and provides a torturous path for foreign material ingress.

Hearing assistance devices typically include at least one enclosure or housing, a microphone, hearing assistance device electronics including processing electronics, and a speaker or "receiver." Hearing assistance devices may include a power source, such as a battery. In various examples, the battery may be rechargeable. In various examples multiple energy sources may be employed. It is understood that in various examples the microphone is optional. It is understood that in various examples the receiver is optional. It is understood that variations in communications protocols, antenna configurations, and combinations of components may be employed without departing from the scope of the present subject matter. Antenna configurations may vary and may be included within an enclosure for the electronics or be external to an enclosure for the electronics. Thus, the examples set forth herein are intended to be demonstrative and not a limiting or exhaustive depiction of variations.

It is understood that digital hearing aids include a processor. In digital hearing aids with a processor, programmable gains may be employed to adjust the hearing aid output to a wearer's particular hearing impairment. The processor may be a digital signal processor (DSP), microprocessor, microcontroller, other digital logic, or combinations thereof. The processing may be done by a single processor, or may be distributed over different devices. The processing of signals referenced in this application can be performed using the processor or over different devices. Processing may be done in the digital domain, the analog domain, or combinations thereof. Processing may be done using subband processing techniques. Processing may be done using frequency domain or time domain approaches. Some processing may involve both frequency and time domain aspects. For brevity, in some examples drawings may omit certain blocks that perform frequency synthesis, frequency analysis, analog-to-digital conversion, digital-to-analog conversion, amplification, buffering, and certain types of filtering and processing. In various examples the processor is adapted to perform instructions stored in one or more memories, which may or may not be explicitly shown. Various types of memory may be used, including volatile and nonvolatile forms of memory. In various examples, the processor or other processing devices execute instructions to perform a number of signal processing tasks. Such examples may include analog components in communication with the processor to perform signal processing tasks, such as sound reception by a microphone, or playing of sound using a receiver (i.e., in applications where such transducers are used). In various examples, different realizations of the block diagrams, circuits, and processes set forth herein can be created by one of skill in the art without departing from the scope of the present subject matter.

It is further understood that different hearing assistance devices may embody the present subject matter without departing from the scope of the present disclosure. The devices depicted in the figures are intended to demonstrate the subject matter, but not necessarily in a limited, exhaustive, or exclusive sense. It is also understood that the present subject matter can be used with a device designed for use in the right ear or the left ear or both ears of the wearer.

The present subject matter may be employed in hearing assistance devices, such as headsets, headphones, and similar hearing devices.

The present subject matter may be employed in hearing assistance devices having additional sensors. Such sensors include, but are not limited to, magnetic field sensors, telecoils, temperature sensors, accelerometers and proximity sensors.

The present subject matter is demonstrated for hearing assistance devices, including hearing aids, including but not limited to, behind-the-ear (BTE), in-the-ear (ITE), in-the-canal (ITC), receiver-in-canal (RIC), or completely-in-the-canal (CIC) type hearing aids. It is understood that behind-the-ear type hearing aids may include devices that reside substantially behind the ear or over the ear. Such devices may include hearing aids with receivers associated with the electronics portion of the behind-the-ear device, or hearing aids of the type having receivers in the ear canal of the user, including but not limited to receiver-in-canal (RIC) or receiver-in-the-ear (RITE) designs. It is understood that other hearing assistance devices not expressly stated herein may be used in conjunction with the present subject matter.

This application is intended to cover adaptations or variations of the present subject matter. It is to be understood that the above description is intended to be illustrative, and not restrictive. The scope of the present subject matter should be determined with reference to the appended claims, along with the full scope of legal equivalents to which such claims are entitled.

What is claimed is:

1. A hearing assistance device, comprising: a housing; a microphone within the housing; hearing assistance electronics within the housing configured to provide audio processing to signals received by the microphone; and a plastic living hinge cover for a momentary multi-function switch integrated with the housing, the plastic living hinge cover integrated with a battery drawer of the hearing assistance device, and configured to improve tactile feel, and including an overlap joint boundary to improve robustness to debris ingress, wherein the plastic living hinge cover includes a snap feature to attach the cover to the housing, a switch bezel configured to include the overlap joint boundary with a perimeter ridge of the housing, wherein the snap feature is configured to interfere with the perimeter ridge to prevent rattling and inhibit debris ingress and provide more consistent gaps in the housing.

2. The device of claim 1, wherein the momentary multi-function switch is configured to change internal memory presets for the hearing assistance device.

3. The device of claim 1, wherein the momentary multi-function switch is configured to adjust volume of the hearing assistance device.

4. The device of claim 1, wherein an underside of the switch bezel is configured to have slight contact interference with the perimeter ridge of the housing.

5. The device of claim 1, comprising an actuator and wherein the perimeter ridge and actuator are mirrored on an opposite side of the snap feature.

6. The device of claim 1, wherein the plastic living hinge cover includes a triple living hinge.

7. The device of claim 1, wherein the hearing assistance device is a hearing aid.

8. The device of claim 7, wherein the hearing aid is a behind-the-ear (BTE) hearing aid.

9. The device of claim 1, wherein the hearing assistance device is an electronic headset device.

* * * * *